US006032839A

United States Patent [19]

Joosten et al.

[11] Patent Number: 6,032,839

[45] Date of Patent: Mar. 7, 2000

[54] AID FOR PUTTING ON ELASTIC STOCKINGS HAVING A CLOSED TOE PORTION

[75] Inventors: Erik Theodorus Johannes Joosten, Cadier en Keer; Huibert Paul Maria Pollmann, Amsterdam, both of Netherlands

[73] Assignee: Arion International B.V., Netherlands

[21] Appl. No.: 09/011,178

[22] PCT Filed: Aug. 2, 1996

[86] PCT No.: PCT/NL96/00312

§ 371 Date: Apr. 6, 1998

§ 102(e) Date: Apr. 6, 1998

[87] PCT Pub. No.: WO97/08981

PCT Pub. Date: Mar. 13, 1997

[30] Foreign Application Priority Data

Aug. 3, 1995 [NL] Netherlands ..... 1000925

[51] Int. Cl.[7] ..... A47G 25/90

[52] U.S. Cl. ..... 223/112; 223/111

[58] Field of Search ..... 223/111, 112, 223/113, 118, 119

[56] References Cited

U.S. PATENT DOCUMENTS

| | | | |
|---|---|---|---|
| 3,401,856 | 9/1968 | Berlin | 223/111 |
| 3,918,131 | 11/1975 | Ausnit | 24/201 |
| 4,260,083 | 4/1981 | Aslin | 223/111 |
| 5,673,826 | 10/1997 | Stolk | 223/112 |
| 5,826,761 | 10/1998 | Basaj | 223/112 |

*Primary Examiner*—Bibhu Mohanty
*Attorney, Agent, or Firm*—Dorsey & Whitney LLP

[57] ABSTRACT

Described is an aid for putting on elastic stockings having a closed toe portion, comprising: a substantially flat and flexible body (101) in the form of a single sheet of smooth material having a substantially triangular configuration; continuous closing strips (112, 113) provided along opposite edges (102, 103) of the body and extending along a part of the length of the sides (102, 103) of the triangular body (101); a coupling means (134; 146; 170) for coupling the closing means (112, 113) together, and a grip (105) provided near the top (104) of the triangular body (101) for removing the aid (100) from between a foot (64) and a stocking (63) applied around said foot. The closing means (112, 113) may be based on, e.g., Velcro®, a zipper with a runner or a plastic zipper.

24 Claims, 10 Drawing Sheets

AID FOR PUTTING ON ELASTIC STOCKINGS HAVING A CLOSED TOE PORTION

RELATED APPLICATIONS

This application claims the priority of PCT Application No. PCT/NL96/00312, filed Aug. 2, 1996 and Netherlands Application No. 1000925, filed Aug. 3, 1995, which are incorporated herein by reference.

BACKGROUND OF THE INVENTION

The present invention relates to an aid for putting on elastic stockings.

An elastic stocking or support stocking is a garment which also functions as a medical aid, because it fits so tight around the leg of the user that it exerts a relatively great elastic force on that leg. Exactly because of that great elastic force the user meets with problems when putting on the stocking. Generally, the user will first bring the stocking into a "rolled-up" condition, insert his foot into the insertion opening of the stocking and then unroll the stocking along his foot and along his leg. As a result, however, the stocking will generally not fit tight enough around the leg. In order yet to realize this, the user must pull the stocking tight, and this requires relatively much force, because the stocking must be pulled along the heel of the foot and the leg and thus undergoes relatively much friction.

The user meets with the greatest problem when the stocking must be moved over the heel, because then the circumference of the body is relatively large and the stocking must therefore be, so to speak, pulled open with the hands.

This problem is so serious in practice that it may occur that the user is not capable of putting on the stocking independently. In this connection it should be borne in mind that the category of persons needing elastic support stockings usually have less power in their hands and arms. In particular, the above problems are felt by people that are disabled and moreover need elastic support stockings: often elderly people.

In order to alleviate such problems, an aid has already been proposed which in general has the form of a double sock, and which is made of a material having a very low coefficient of friction. This known aid is described in, e.g., European patent 0 497 858. It operates as follows: Before the user puts on an elastic stocking, he first applies the sock-shaped aid around his foot. Subsequently, he puts on the stocking over the sock-shaped aid, which is done with little friction and is therefore relatively easy. The sock-shaped aid is finally removed by pulling away that sock-shaped aid from between the foot and the stocking, which also requires relatively little force, because the aid slides, on the one hand, along the stocking and, on the other hand, along itself.

This known sock-shaped aid, however, is only suitable for use with elastic stockings having an open toe portion, because that opening in the toe portion is utilized to remove the aid.

SUMMARY OF THE INVENTION

It is a general object of the invention to provide a comparable aid suitable for use with elastic stockings having a closed toe portion.

An aid for putting on stockings, intended for use with elastic stockings having a closed toe portion, is already known per se in practice. After use this is removed from under the stocking via the opening of the stocking directed towards the knee. This aid, however, is rather complicated and expensive, as will be explained below in more detail, and is moreover rather difficult to use.

It is a further general object of the invention to improve this known aid for putting on stockings.

More in particular, it is an object of the invention to provide an aid for putting on stockings suitable for use with elastic stockings having a closed toe portion, which contains relatively little material, can be manufactured relatively inexpensively, is particularly reliable in operation, and can be used very easily.

An aid according to the invention for putting on stockings having all the above advantages is described in claim 1.

The above and other aspects, features and advantages of the present invention will be explained by means of the following description of preferred embodiments of an aid according to the invention for putting on stockings, with reference to the accompanying drawings, in which:

DETAILED DESCRIPTION OF THE PREFERRED EMBODIMENT

Figure 1:
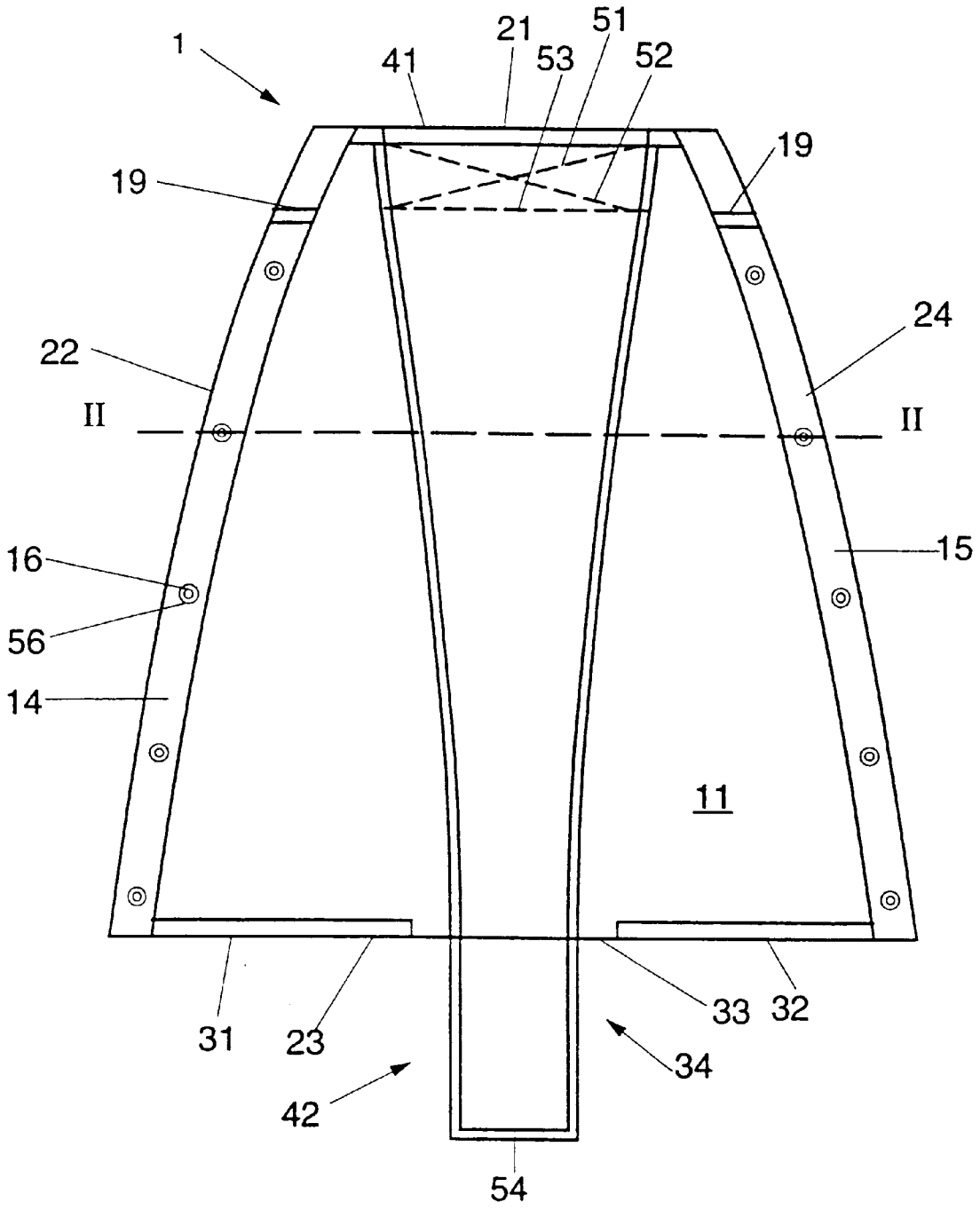
FIG. 1 is a top plan view of a known aid for putting on stockings.
Figure 2:
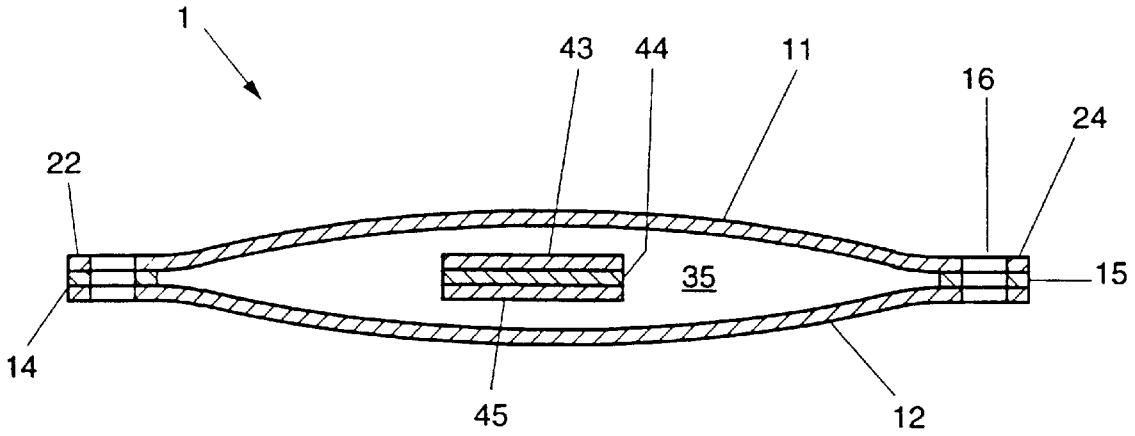
FIG. 2 is a cross-sectional view of this known aid for putting on stockings, taken along the line II—II in FIG. 1.

FIG. 1 is a top plan view of an aid 1 known in practice for putting on stockings, intended for use with elastic stockings of which the toe portion is closed. This known aid 1 consists of two sheers 11, 12 of a smooth material, which are superimposed, as clearly shown by the cross-sectional view of FIG. 2. Each sheet 11, 12 has four edges 21, 22, 23, 24. The first edge 21 is directed parallel to the opposite third edge 23 and is shorter than this third edge 23. The second and fourth edges 22 and 24 are convexly curved.

The sheets 11 and 12 are sewn together throughout the length of their first, second and fourth edges 21, 22, 24. Furthermore, the sheets 11 and 12 are sewn together over two pieces 31, 32 of about one third of the length of the third edge 23, always connecting to the second edge 22 and the fourth edge 24, respectively. In other words, the only edge portion 33 where the sheets 11 and 12 are not sewn together is a central portion of the third edge 23 and has a length of about one third of the length of that third edge 23. This edge portion 33 therefore defines a mouth 34 for the space 35 present between the sheets 11 and 12.

Interposed between the sheets 11 and 12 is a pulling member 13, which is sewn at a first end 41 onto the first edges 21 of the sheets 11 and 12, as illustrated in FIG. 1 by stitched seams 51, 52, 53, drawn in dotted lines. The length of that pulling member 13 is such that the other end 42 projects through the mouth 34. In FIG. 1 the portion of the pulling member 13 located within the space 35 is drawn in dotted lines. The width of the pulling member 13 converges from a width corresponding substantially to the length of the first edge 21 at the first end 41 to a smaller width at the other end 42. Throughout its length the pulling member 13 consists of three layers 43, 44, 45, sewn together along the entire length of the four edges of the pulling member 13, as illustrated in FIG. 1 by the stitched seam 54, the outer layers 43 and 45 also being made of the above smooth material.

Strengthening strips 14 and 15 are sewn throughout the lengths of the second and fourth edges 22 and 24, respectively. Each strengthening strip 14 and 15 is provided on its outside with a layer of the above smooth material. In these strengthening strips 14 and 15 holes 16 are made, the edges of which are provided with stitched edges 56 for strengthening purposes, comparable with the stitched edges of a buttonhole.

Figure 3:
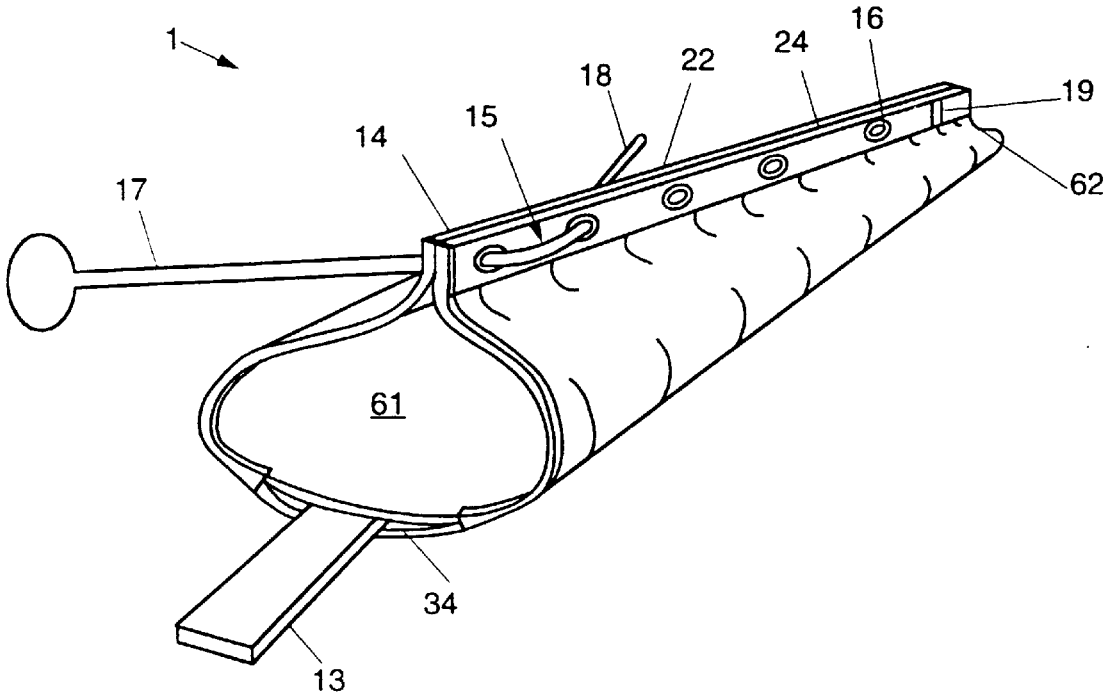
FIG. 3 is a diagrammatic perspective view of this known aid for putting on stockings in an operating condition.

In order to use the known aid 1, this is first put in an operating condition, as illustrated in perspective in FIG. 3. To this and, the aid 1 is folded, so that the edges 22 and 24 are superimposed, in such a manner that the holes 16 are in alignment. Subsequently, those edges 22 and 24 are interconnected by passing a plastic coupling rod 17 through the holes 16. This coupling rod 17 must be rather strong and is therefore relatively stiff, but must also be elastic enough to be passed through the holes 16. After threading, the end 18 of the coupling rod 17 must be secured with respect to the sheets 11 and 12, because otherwise the edges 22 and 24 come apart and the aid 1 becomes ineffective. To this end, the second and fourth edges 22 and 24 are provided, near the first edge 21, with an insertion pocket 19.

Figure 4A:
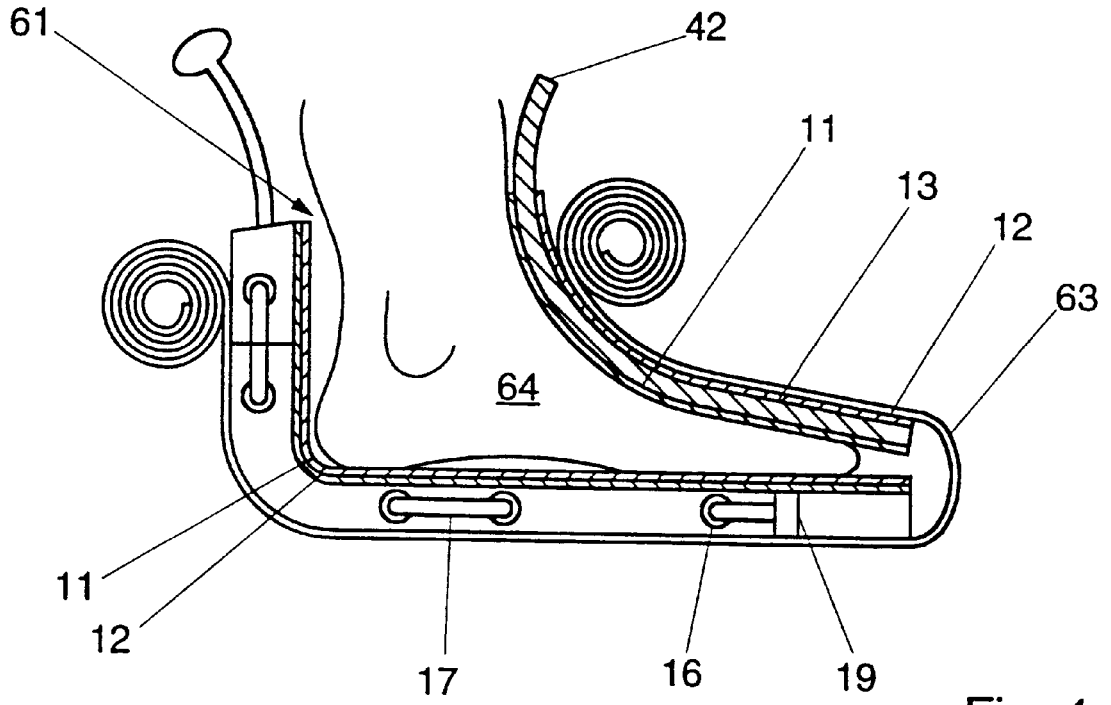
FIGS. 4A–4B illustrate the use of this known aid for putting on stockings.

Thus, in the operating condition, the aid 1 has a tubular configuration, the transverse dimension of which tapers from an insertion mouth 61 at the third edge 23 of the sheets 11, 12 to a nearly closed end 62. To put on a stocking 63, the user inserts his foot 64 in the insertion mouth 61 of that tube 1. Then he pulls on the stocking 63 over the tube 1, as illustrated in FIG. 4A.

Figure 4B:
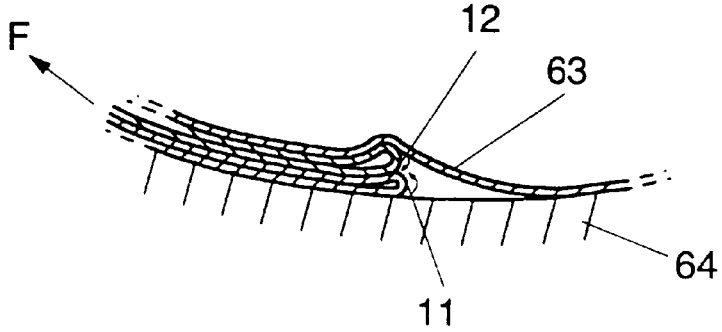

Subsequently, the tube 1 must be removed. To this end, the coupling rod 17 must first be drawn out, after which a pulling force F must be exerted on the free end 42 of the pulling member 13. The aid 1 is thereby turned inside out via the mouth opening 34, which meets with little friction, because the sooth material only slides along itself, as illustrated in FIG. 4B.

Then the stocking 63 can be unrolled further along the leg.

As will be clearly apparent from the above description, the known aid 1 has a rather complicated construction and requires quite a lot of (relatively expensive) smooth material.

Furthermore, the manufacture of the known aid 1 is rather complicated and is therefore rather expensive, inter alia because of the many stitched seams, the holes 16 for the coupling rod 17, and the insertion pocket 19 for the end 18 of the coupling rod 17.

Moreover, the use of the known aid 1 is rather difficult. In the first place, the coupling rod 17 must be threaded, which in itself requires quite a lot of operations.

In the second place, the end 18 of the coupling rod 17 must be inserted rather accurately in the above insertion pocket 19. Because of the very short distance between the last coupling hole 16 and the insertion pocket 19, it is rather difficult to insert the end 18 of the coupling rod 17 in that insertion pocket 19, and one tends to insert the coupling rod 17 not far enough through the holes 16, 50 that the length of the portion of the coupling rod 17 that extends into the insertion pocket 19 is rather short. This has the result that the coupling rod 17 leaves that insertion pocket 19 rather easily, so that in an case the last holes 16 come apart.

However, also when the end of the coupling rod 17 is in the insertion pocket 19, the coupling rod 17 provides an inadequate attachment of the two edges 22, 24, because the holes 16 of the opposite edges 22, 24 can remove from each other along the coupling rod 17. A coupling rod 17 therefore provides no positive attachment of the edges 22, 24 of the sheets 11, 12 and is therefore nor reliable.

It is considered a further drawback that after use the known aid 1 is turned inside out and that therefore additional operations are required to make this aid 1 ready for use again. Because of the relatively complicated form of the known aid 1 and the relatively narrow mouth 34 thereof, this is not easy.

It is further considered a drawback of the known aid 1 that in the operating condition (see FIG. 3) the superimposed strengthening strips 14 and 15 must substantially be at right angles to the tubular form of the body 1, in order to enable the threading of the coupling rod 17. A Consequence thereof is that in use (FIG. 4A) the above strengthening strips 14 and 15 form a rather thick ridge under the foot 64 of the user, which is felt to be unpleasant.

The international patent application WO 95/02980 describes an aid identical with the above-described known aid 1, with the exception that the coupling rod 17 has a dumbbell-shaped cross-section with two C-shaped side pieces engaging with cylindrical coupling strips provided along the edges 22 and 24 to replace the holes 16. In order to apply the coupling rod, this rod must be moved in its longitudinal direction over the cylindrical coupling strips, for which purpose the ends of the two cylindrical coupling strips must be aligned with the ends of the two C-shaped side pieces of the coupling rod, which is difficult in practice. More in particular, it is not possible to couple the coupling strips one after another with the coupling rod.

Figure 5:
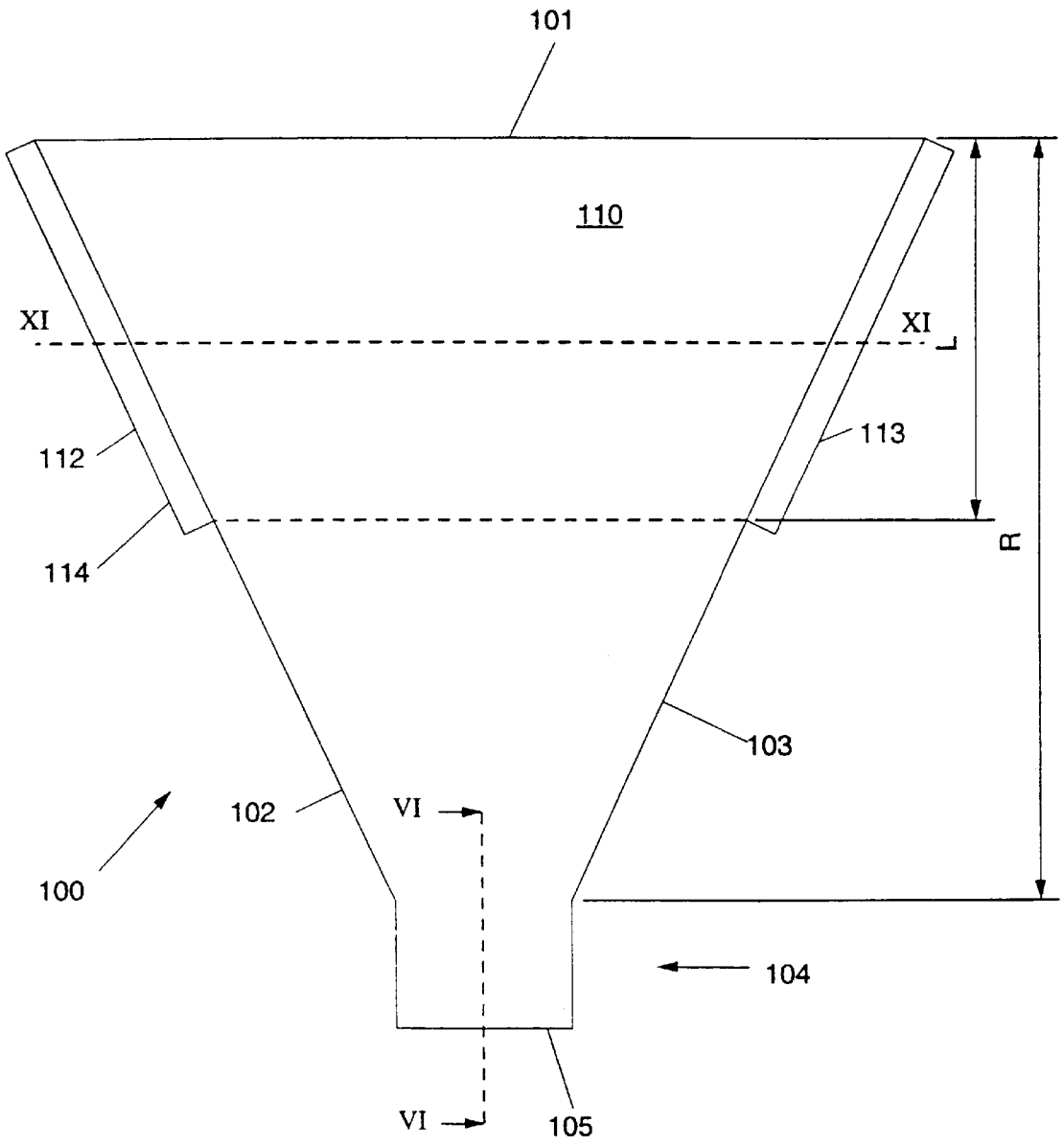
FIG. 5 is a top plan view of an aid according to the invention for putting on stockings.

FIG. 5 shows an embodiment of an aid 100 according to the invention for putting on stockings. This aid 100 substantially comprises a single sheet 110, which generally has the form of a triangle. The single sheet 110 is made of a material having a low coefficient of friction; an example of such a material is a plastic cloth, also referred to as spinnaker cloth, provided with a PTFE coating. Such a material is known per se.

Figure 6:
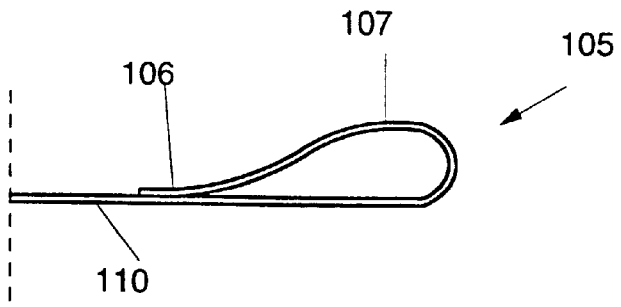
FIG. 6 is a cross-sectional view of a portion of this aid for putting on stockings, taken along the line VI—VI in FIG. 5.

The triangular aid 100 has a base 101 and two substantially straight side edges 102 and 103, which meet at a top 104. Attached at the top 104 is a gripping member 105, so that a user can grip that top 104 and exert a pulling force thereon. In an embodiment preferred in view of its simplicity, that gripping member 105 is a loop formed by folding back the sheet 110 at the top 104 along a specific length and sewing the end 106 of the folded-back portion 107 onto the sheet 110, as illustrated in FIG. 6. The edges of the folded-back portion 107 may be parallel to each other.

Starting from the base 101, continuous closing strips 112 and 113 are attached along a part of the side edges 102 and 103. These continuous closing strips 112 and 113 are designed for being brought into positive engagement with each other throughout their length, as will be explained below in more detail. The length L of these closing strips 112 and 113 is less than half of the length R of the side edges 102 and 103, measuring from the base 101 to the gripping member 105. Examples of such closing strips 112 and 113 will be discussed below.

An important advantage of the aid according to the present invention is that it requires relatively little material and that relatively few operations are needed for the manufacture.

With reference to FIG. 7 the operation of the triangular aid 100 according to the present invention will now be discussed.

Figure 7A:
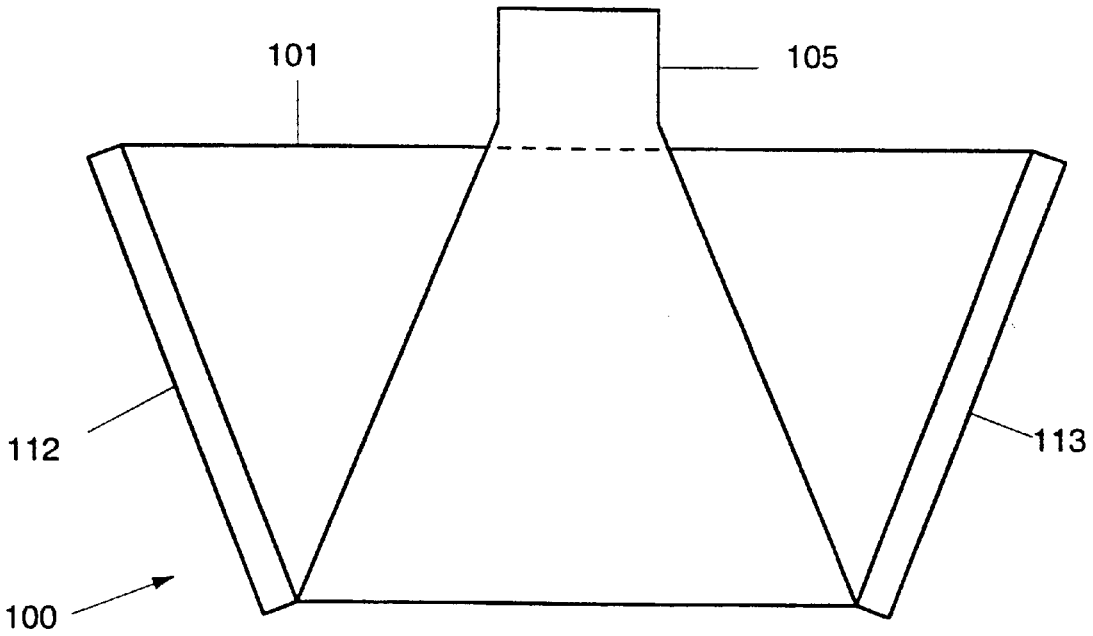
FIG. 7A shows a first step in the use of the aid according to the invention for putting on stockings.

In a first step the user folds the cop 104 back to the base 101 along a folding line 114, indicated in FIG. 5 by a dotted line, which interconnects the ends of the closing strips 112 and 113 near the halfway point of the triangular aid 100 (see FIG. 7A).

Figure 7B:
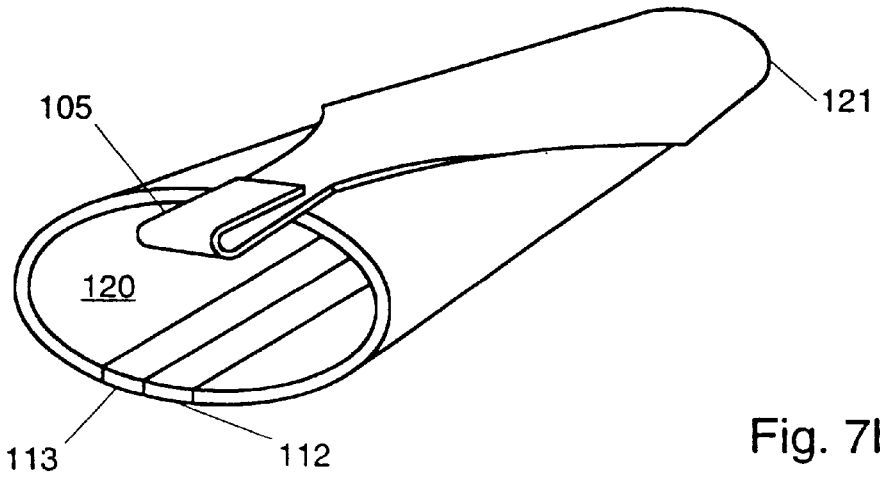
FIG. 7B is a diagrammatic perspective view of this known aid for putting on stockings in an operating condition.

Subsequently, the user folds the closing strips 112 and 113 towards each other, away from the folded-back half of the aid 110, and fastens the closing strips 112 113 together. As illustrated in FIG. 7B, the aid 100 now has the form of a tapering tube with an insertion mouth 120 and an end 121 having a smaller transverse dimension, the folded-back half of the aid 110 being located on the outside of that tube. Since the folded-back half of the aid 110 is located on the outside of the tube, the order of the above operations may also be reversed, if desired.

Subsequently, the user inserts his foot 64 in the insertion mouth 120, until the end 121, while the aid 100 behaves like a loose fitting smooth sock. Because of the positive attachment of the closing strips 112 and 113 to each other throughout their lengths, there is no risk of the aid 100 becoming ineffective, because the closing strips 112 and 113 will nowhere come apart.

The user then puts on a support stocking 63 over that smooth sock, which will be very easy, because the support stocking 63 will slide nearly without friction over the smooth material of the sock.

Figure 7C:
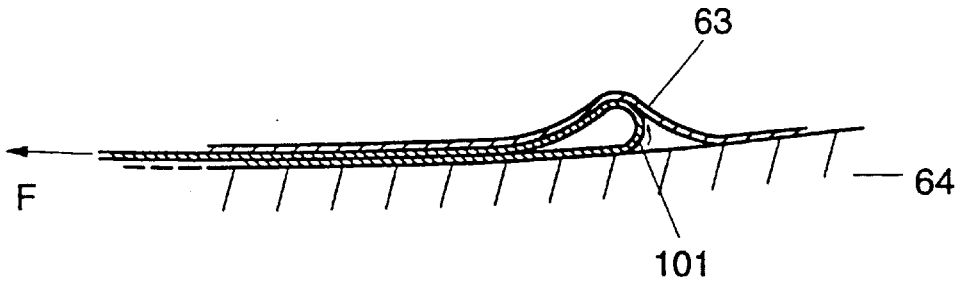
FIG. 7C illustrates in detail the step of removing the aid according to the invention for putting on stockings.

When the support stocking 63 has been put on far enough, the aid 100 can be removed. To this end, the closure of the closing strips 112 and 113 is undone, as will be explained below in more detail. Subsequently, the user pulls the loop 105 so as to pull away the aid 100 from between the foot 64 and the stocking 63. Substantially no friction occurs therewith: as illustrated in FIG. 7C, the moving part of the sheet 101 of the aid 100 contacts the stocking 63 with one surface and meets with little friction therefrom, with the other surface the moving part of the sheet 101 contacts the stationary part of itself: this mutual sliding contact of two layers of the smooth material causes substantially no friction. The part of the sheet 101 that contacts the foot 64, which contact could in principle cause a relatively great frictional force, remains stationary, until that portion is reached by the moving portion of the sheet 101 and is folded back over itself away from the foot 64. Accordingly, the sheet 101 is, so to speak, stripped off the foot 64 from under the stocking 63.

A further important advantage of the aid 100 according to the present invention is that now, i.e. after removal from the foot 64, it is immediately ready for further use and is not folded inside out, as the known aid 1.

Figure 8A:
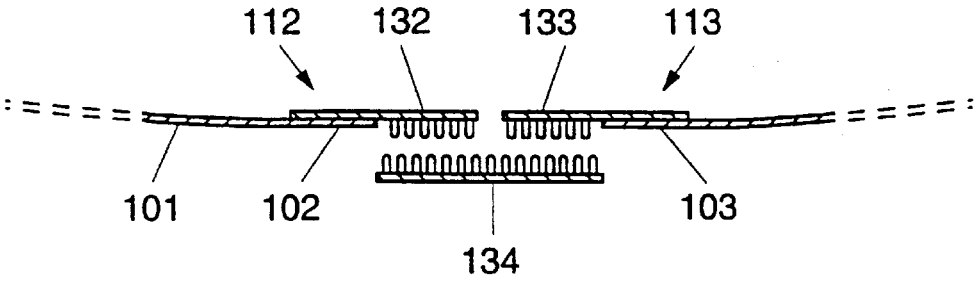
FIGS. 8A–8B illustrate a first embodiment of the closing strips of the aid according to the invention for putting on stockings.

FIG. 8A illustrates a first example of suitable closing strips 112, 113, which example is based on the use of velcro. As is commonly known, Velcro consists of a combination of two material bands provided with mutually engaging elements. Within the scope of the present invention such engaging bands will be designated as primary band and secondary band. In an illustrative example the primary band possesses primary engaging elements in the form of loops, and the secondary band possesses secondary engaging elements in the form of engaging hooks, as is commonly known.

As illustrated in FIG. 8A, the closing strips 112 and 113 are defined by primary bands 132 and 133 mounted along the respective edges 102 and 103, while there is further provided a separate secondary band 134. The closing strips 112 and 113 are easily attached together by juxtaposing the primary bands 132 and 133 and applying over them the secondary band 134 functioning as a coupling strip.

In the first place, it will be clear that the exact positioning of the prim bands 132 and 133 with respect to each other is not critical upon closure, while there is yet provided a strong positive attachment of the closing strips to each other, which is effective throughout the lengths of the closing strips 112, 113.

In the second place, it will be clear that the primary bands 132 and 133 can be relatively easily mounted on the respective edges 102 and 103 of the sheet 101 e.g. by means of some simple stitched seams made by a sewing machine.

Figure 8B:
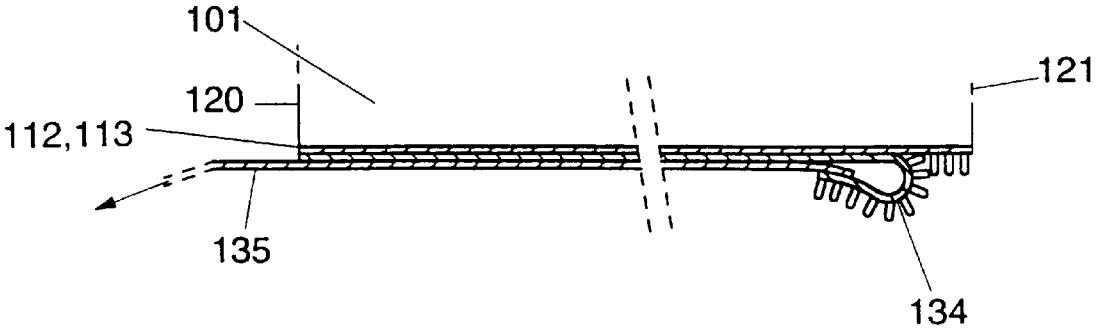

Although the coupling between primary and secondary bands can resist a relatively great pulling force, the coupling band 114 can be easily removed notwithstanding. The principle thereof is illustrated in FIG. 8B. The coupling band 134 is, e.g., more than twice as long as the primary bands 132 and 133 or comprises an extension strip 135 of another material. When preparing the aid 100, the beginning of the coupling band 134 is substantially aligned with the insertion mouth 120, so that the extension strip 135 extends beyond the narrow end 121 of the tube, and then the extension strip 135 is likewise folded back to the insertion mouth 120. The coupling band 134 is removed, after applying the stocking, not shown in FIG. 8B for simplicity's sake, by supply pulling the extension strip 135, so that the coupling band 134 will be stripped off along itself.

Besides, the above step of folding back the extension strip 135 cakes place nearly automatically upon pulling the stocking over the aid 100, when the coupling band 134 is located on the outside of the tube, i.e. between the aid 100 and the stocking.

Figure 9A:
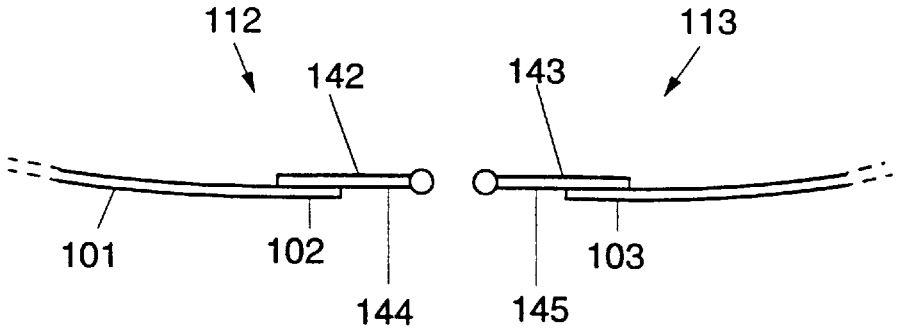
FIGS. 9A–9B illustrate a second embodiment of the closing strips of the aid according to the invention for putting on stockings.

FIG. 9A illustrates a second example of suitable closing strips 112, 113, which example is based on the use of a zipper. As is commonly known, a zipper likewise consists of a combination of two material bands provided with mutually engaging elements. An example possesses on both bands a helical body, the individual windings of which can engage with the windings of the helical body of the other band. The mutual windings are engaged or disengaged by means of a so-called runner.

As illustrated in FIG. 9A, the closing strips 112 and 113 are defined by material bands 142 and 143 mounted along the respective edges 102 and 103 and provided with a continuous helical body 144 and 145, respectively. For the closing strips 112 and 113 to be opened/closed, a runner 1a6 is provided, the narrow closing side of which is directed towards the insertion mouth 120 of the cube, while the wide open side is directed towards the narrow end 121 of the tube. Furthermore, the material bands 142 and 143 are provided at their ends with stop elements 147, 148 to prevent the runner 146 from loosening.

Since the functioning of such a zipper is held to be commonly known, this will not be explained in more detail. On the other hand, it is observed chat exactly the fact that such a zipper is commonly known to the final user is regarded as a contribution to the ease of operation and thus as an advantage of this embodiment according to the invention.

It will be clear that it is also rather easy to mount such a zipper on the respective edges 102 and 103 of the sheen 101.

Figure 9B:
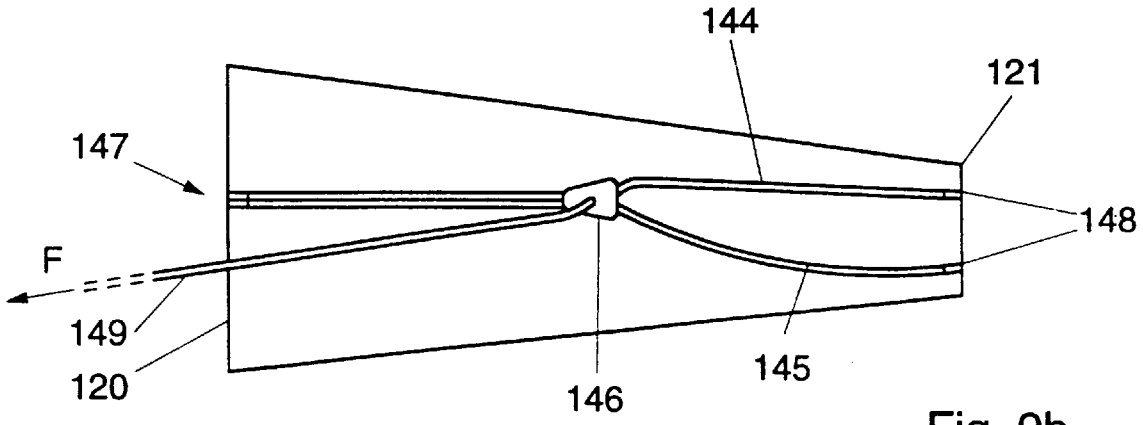

For loosening the closing strips 112 and 113, when the stocking 63, not shown in this figure for simplicity's sake, is applied around the aid 100, a cord 149 is attached to the ruiner 146, as diagrammatically illustrated in FIG. 9B, the free end of which, upon putting on the stocking, will automatically be directed towards the insertion mouth 120. The user can now pull the cord 149 so as to draw towards himself and thus open the zipper. The pulling cord 149 is advantageously not attached to a pulling lip as usually attached to a runner, but to a hole provided in the body of the runner 146 near the wide open side. It is also possible that the runner 146 is provided with a pulling lip both at its upper side and at its lower side, with a pulling card being attached to both pulling lips. The free ends of these two pulling cords can advantageously be attached together, or they form one continuous pulling cord.

An important advantage of this embodiment is that the runner 146 at all times remains attached to one of the two bands 142, 143. The known aid 1, however, has the drawback that the coupling rod 17 is a loose part and that the user must always ensure that he keeps the two parts together.

Figure 10A:
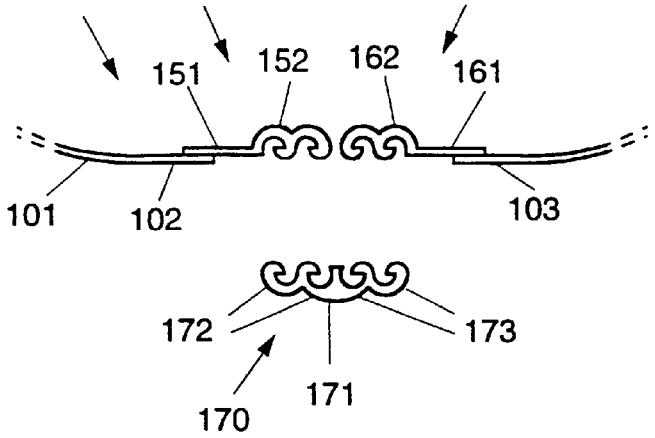
FIGS. 10A–10D illustrate a third embodiment of the closing strips of the aid according to the invention for putting on stockings.
Figure 10B:
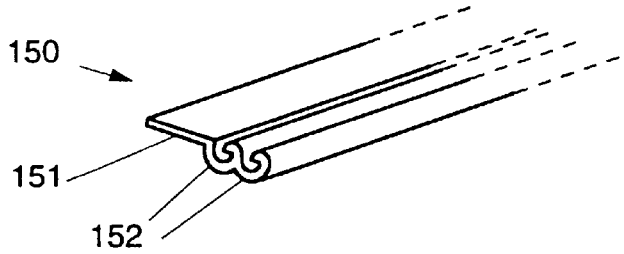

FIG. 10A illustrates a third example of suitable closing strips 112, 113, which third example is based on the use of a so-called plastic zipper. Such a zipper also consists of a combination of two material bands provided with engaging elements. FIG. 10B is a diagrammatic perspective view of such a material band 150. The band 150 has a attachment strip 151 for attaching the band 150 to the sheet 101. Along a longitudinal edge of the attachment strip 151 there is formed at least one ridge 152 having a hooked cross-section. In the embodiment given, two of such ridges 152 are provided side by side. It will be clear that the number of ridges may also equal three or more. The attachment strip 151 may easily be made integral with the at least one ridge 152 by means of an extrusion process.

As shown in FIG. 10A, identical bands 150 and 160 are mirror-symmetrically attached along the respective edges 102 and 103, e.g. by means of sewing or glueing, to define the closing strips 112 and 113. FIG. 10A further shows a separate coupling band 170 comprising a central body 171 and ridges 172, 173 on both sides of that body 171. More in particular, the number of ridges 152 of the band 150 equals the number of ridges 162 of the band 160, while the number of ridges 172 and the number of ridges 173 equal the above number.

Figure 10C:
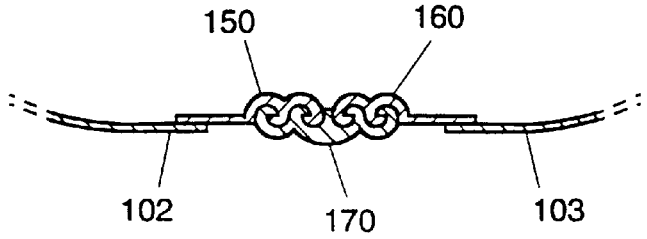

As more in particular illustrated in FIG. 10C, the ridges 172 and 173 are so formed as to fit into the ridges 152 and 162. By means of the hooked cross-section of the ridges the engagement can be easily affected by laying the coupling band 170 on the juxtaposed bands 150 and 160 and then pressing the bands into each other. However, the hooked cross-section of the ridges has the result that in the engaging condition the bands 150, 160, 170 can resist relativly great lateral forces.

As will be clear, the bands 150 and 160 thus coupled together via the coupling band 170 provide a continuous engagement throughout the lengths of the closing strips 112 and 113. Since the bands 150, 160, 170 are very elastic with respect to deflections in a direction perpendicular to the body surface of the bands, they can easily follow the curves of a heel.

After applying the stocking around the foot, the connection between the bands 150 and 160 can be undone very easily by exerting a pulling force on the end of the coupling band 170 located near the insertion mouth 120, so that the coupling band 170 moves out of the bands 150 and 160 in the longitudinal direction of the above ridges. This requires little force, since the engaging elements have no securing function in this direction. It is advantageous to select for the bands 150, 160 and 170 a material having a low coefficient of friction.

Figure 10D:
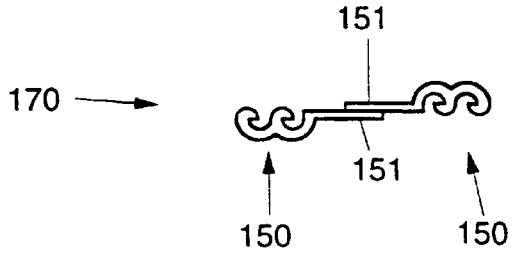

As already observed, the bands 150 and 160 are identical with each other. Preferably, they are so formed as to fit into each other. It is then possible to make a coupling band 170 by attaching two bands 150 together with their attachment strips 151, e.g. by means of glueing, welding or sewing, as illustrated in FIG. 10D.

It is observed, however, that such plastic zippers are known per se and are sold, e.g., under the trade name of Maxigrip by the firm of ITW in New Jersey, U.S.A., and are described in, e.g., U.S. Pat. No. 3,918,131.

Figure 13A:
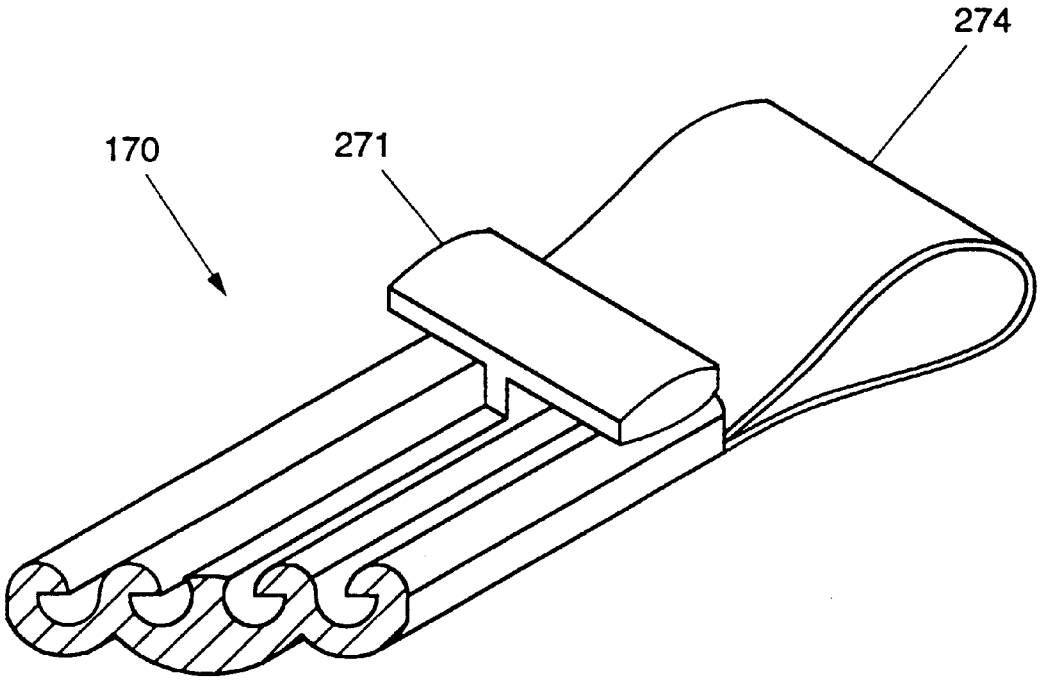
FIG. 13A is a diagrammatic perspective view of a detail of an embodiment of a coupling band, partially cut away.

In a special variant of embodiment the coupling band 170 is provided at at least one of its ends and preferably at both ends with a substantially T-shaped body portion 271, as illustrated in FIG. 13A. This body portion 271 prevents the coupling band 170 from being disengaged with the bands 150, 160.

Figure 13B:
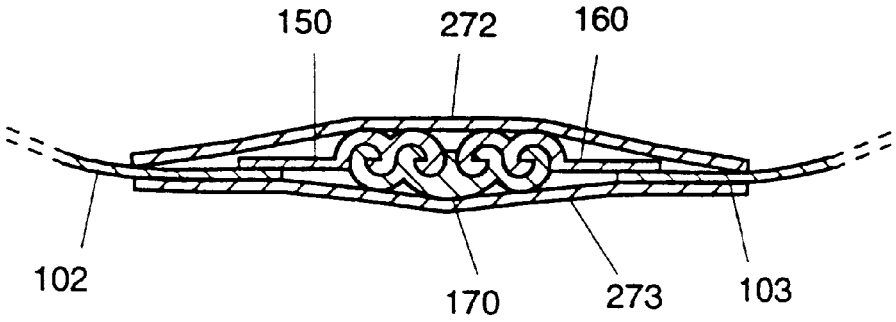
FIG. 13B is a diagrammatic cross-sectional view of a detail of an embodiment of a closing strips.

FIG. 13B diagrammatically sows the ends of the bands 150, 160. In this special variant of embodiment these ends are connected with two bridges 272, 273 of a suitable material, such as, e.g. leather. Wenn pulling loose the coupling band 170, the T-shaped body portion 271 will be retained by the bridges 272, 273, so that coupling band 170 always remains connected with the bands 150, 160, which increases the ease of operation, because no loose parts are present now. In this variant of embodiment the aid is removed after use from the leg by moving it over the stocking to the root and removing it via the foot.

Preferably, the coupling band 170 and the bridges 272, 273 are provided with tpulling lips 274.

If desired, the bridges 272, 273 can be detachably connected with the ends of the bands 150, 160, e.g. by means of one or more press buttons.

Figure 11:
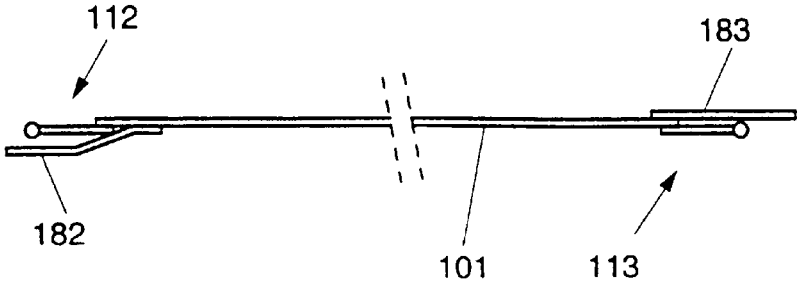
FIG. 11 is a diagrammatic cross-sectional view of the aid according to the invention for putting on stockings, taken along the line XI—XI in FIG. 5.

In the embodiments described in the foregoing the closing strips 112 and 113 can contact the foot 64 and/or the stocking 63. If this is considered a drawback, it is readily possible within the scope of the present invention to apply protective strips of the same smooth material as that of the sheet 101. FIG. 11 illustrates this for the embodiment with a zipper as discussed with reference to FIG. 9A–B. At the lover side of the sheer 101 a protective strip 182 is attached along the closing strip 112, and at the upper side of the sheet 101 a protective strip 183 is attached along the closing strip 113. When the sheet 101 is folded and the closing strips 112 and 113 are moved towards each other in order to reach the operating condition illustrated in FIG. 7B, the protective strips 182 and 183 will be positioned on both sides of the engaging closing strips 112 and 113, so that they will be, so to speak, located in a protective tube defined by the protective strips 182 and 183.

This protective cube has several advantages. As stated, the protective tube prevents a direct contact between the closing mechanism and, on the one hand, the skin and, on the other hand, the stocking. This results in a decreased friction of the closing element to be removed (runner 146; coupling strip 170) with respect to, on the one hand, the skin and, on the other hand, the stocking. Furthermore, the risk of damage to the stocking under the influence of the closing mechanism is reduced as much as possible. It is further prevented that when putting on the stocking 63 over the aid 100 the closing element (runner 146; coupling scrip 170) is erroneously displaced, thus undesirably opening the closing mechanism. The protective tube further provides a guide tunnel for the closing element to be removed, which is of special advantage in the case of a runner with a pulling cord.

Figure 12A:
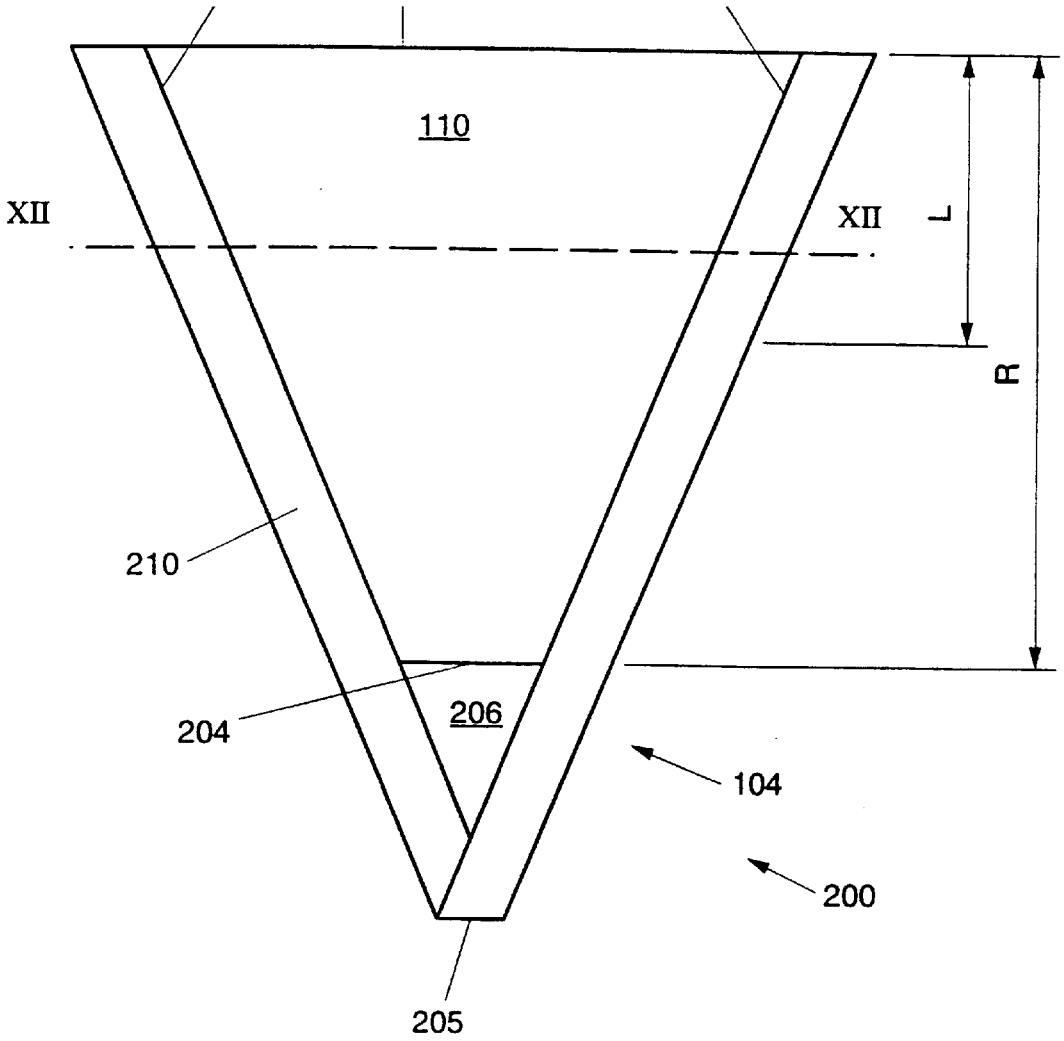
FIG. 12A shows a preferred embodiment of the aid according to the invention for putting on stockings.

In the example of FIG. 11 the protective tube is defined in the closed operating condition of FIG. 7B by two protective strips. When the closing element is removed, the portions of the closing strips 112 and 113 coming apart can contact the toot 64 and/or the stocking 63 notwithstanding. In order to avoid this too, a protective strip is preferably attached on both sides of each closing strip 112 and 113. A preferred embodiment of an aid according to the invention for putting on stockings, in which this constructional detail is used, is indicated in FIGS. 12A and 12B by reference numeral 200, the same or comparable parts as those of the aid for putting on stockings as illustrated in FIG. 5 being indicated by the same reference numerals.

The aid 200 for putting on stockings likewise comprises a single sheet 110 having a generally triangular form. In the illustrated example this triangular form is blunted at the top 104, so that the form may also be indicated as a trapezoidal form having an upper edge 204. As is the case with the aid 100 for putting on stockings, closing strips 112 and 113 are provided along the side edges 102 and 103 along a length indicated by L, which closing-strips 112 and 113, however, are not separately show in FIG. 12A, for clarity's sake. The manner of providing these closing strips 112 and 113 will be explained below with reference to FIG. 12B.

Substantially throughout the length R of the side edge 102 there is provided an elongated supporting element 210. The supporting element 210 extends beyond the upper edge 204 of the sheet 110, is folded back over itself at 205, and the folded-back portion of the supporting element 210 is attached to the side edge 103, likewise substantially throughout the length thereof. The supporting element 210 defines at its central portion 205 an engaging element, to which a user can apply a pulling force, during which the supporting element 210 with the upper edge 204 of the sheet 110 encloses an opening 206, through which the user can put one or more fingers to allow a proper grip on the supporting element 210. By means of the construction of the supporting element 210 shown, the pulling force applied is adequately transmitted to and distributed over the edges 102 and 103 of the sheet 110.

Figure 12B:
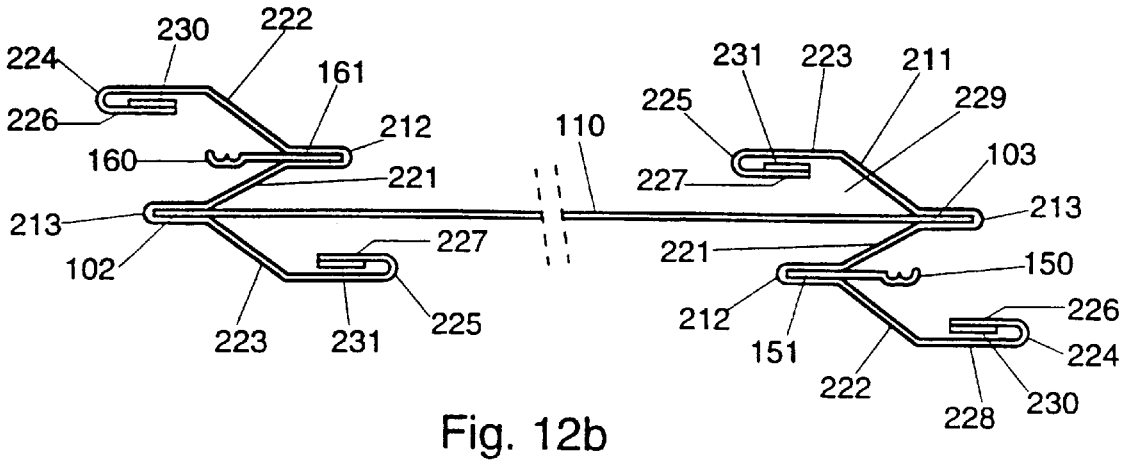
FIG. 12B is a diagrammatic cross-sectional view of the aid according to the invention for putting on stockings, taken along the line XII—XII in FIG. 12A.

The structure of the supporting element 210 appears from the cross-section thereof shown in FIG. 12B, in which the sizes and distances are shown excessively large, for clarity's sake. To put it briefly, the supporting element 210 is formed from a single sheet 211 of preferably the same material as the sheet 110, which is provided with two folding seams 212 and 213 extending in the longitudinal direction of supporting element 210 and having opposite folding directions, so that the supporting element 210 has a Z-shaped cross-section with a body 221, a first arm 222 and a second arm 223, the first arm 222 having a greater length than the body 221. To strengthen the supporting element 210, the first arm 222 is preferably provided at its end 224 with a third folding seam having the same folding direction as the first folding seam 212, and the second arm 223 is preferably provided at its end 225 with a fourth folding seam having the same folding direction as the second folding seam 213. There is thus defined a first lower arm 226 extending from the third folding seam 224 in the space 228 between the first arm 222 and the body 221, and a second lower arm 227 extending from the fourth folding seam 225 in the space 229 between the second arm 223 and the body 221. At its surface directed towards the first arm 222, the first lower arm 226 may further be provided with a strengthening strip 230, e.g. an adhesive strip, the material of which need not be similar to the material of the sheet 211, in a comparable manner the second lower arm 227, at its surface directed towards the second arm 223, may be provided with a strengthening strip 231.

From the viewpoint of manufacturing engineering, the construction has the advantage that the closing strips 112 and 113 can be attached to the supporting element 210, instead of directly to the sheet 110, e.g. with a simple stitched seam. The whole of the supporting element 210 with the closing strips 112 and 113 attached thereto can be attached to the sheet 110, e.g. likewise with a simple stitched seam, which in themselves are simple operations.

In FIG. 12B this is illustrated for the closing strips 150 and 160 of FIGS. 10A–C. The sheet 110 is sewn with its edges 102 and 103 into the second folding seam 213. The strengthening strip 151, 161 of the closing strip 150, 160 is sewn into the first folding seam 212. The portions of the supporting element 210 located on both sides of the closing strip 150, 160, namely the body 221, on the one hand, and the combination of the first arm 222 and the first lower arm 226, on the other hand, form a protective tube for the closing strip 150, 160. When the closing strips 150 and 160 engage with each other, the outer surface of the protective tube, both on the upper side and on the lower side, will be provided by the first arm 222.

It will be clear to those skilled in the art that it is possible to change or modify the illustrated embodiment of the device according to the invention without departing from the inventive concept or the scope of protection, as defined in the claims. Thus, e.g. in the embodiment illustrated in FIG. 12B, the second arm 223 may be left our, if desired.

We claim:

1. An aid for putting on elastic stockings having a closed toe portion, comprising:

a substantially flat and flexible body of smooth material;

closing means provided along opposite edges of the body, wherein the closing means are continuous closing strips extending along at least part of the length of the sides of the body;

a coupling means for coupling the closing means together; and means for removing the aid from between a foot and a stocking applied around said foot;

characterized:

in that the body is defined by a single sheet having a substantially triangular, at least tapering configuration; and that the removing means comprise a grip provided near the top of the triangular body.

2. An aid according to claim 1, wherein the sides of the triangular body are linear.

3. An aid according to claim 1, wherein the removing means comprise a loop defined by a folded-back portion of the top of the triangular body or a separately attached loop.

4. An aid according to claim 1, wherein the closing means comprise primary bands of a hook and loop type fastener system provided along the respective sides of the triangular body, and wherein the coupling means comprises a secondary band of said hook and loop type fastener system.

5. An aid according to claim 2, wherein the secondary band is provided with an extension strip.

6. An aid according to claim 1, wherein the closing means comprise zipper halves provided along the respective sides of the triangular body, and wherein the coupling means comprises a runner.

7. An aid according to claim 6, wherein the runner is provided with a pulling cord.

8. An aid according to claim 1, wherein the closing means comprise material bands provided along the respective sides of the triangular body, wherein each material band is provided along the edge of an attachment strip with at least one ridge having a hooked cross-section, and wherein the coupling means comprises a coupling band provided with ridges fitting the ridges and also having a hooked cross-section.

9. An aid according to claim 1, wherein at least one protective strip is provided along at least one side of at least one closing strip.

10. An aid according to claim 1, wherein there is provided a supporting element attached on both sides of the sheet.

11. An aid according to claim 10, wherein a point of the triangular sheet is blunted to form an upper edge, and wherein said upper edge encloses an opening together with the supporting element.

12. An aid according to claim 10, wherein the supporting element is formed from a single sheet of preferably the same materials as said sheet, said sheet comprising two folding seams and extending in the longitudinal direction of the supporting element and having opposite folding directions, so that the supporting element has a Z-shaped cross-section.

13. An aid according to claim 12, wherein the closing means is fixed by means of a stitches seam, into the first folding seam, and wherein said sheet is fixed with is edge, e.g. by means of a stitched seam, into the second folding seam.

14. An aid according to claim 8, wherein the coupling band is provided at least one of its ends with a T-shaped body portion, and wherein the bands are connected at one end by bridges.

15. An aid according to claim 2, wherein the sides of the triangular body are linear.

16. An aid according to claim 2, wherein the removing means comprise a loop defined by a folded-back portion of the top of the triangular body or a separately attached loop.

17. An aid according to claim 6, wherein the sides to the triangular body are linear.

18. An aid according to claim 6, wherein the removing means comprise a loop defined by a folded-back portion of the top of the triangular body or a separately attached loop.

19. An aid according to claim 8, wherein the sides of the triangular body are linear.

20. An aid according to claim 8, wherein the removing means comprise a loop defined by a folded-back portion of the top of the triangular body or a separately attached loop.

21. An aid for putting on elastic stockings comprising:

a substantially flat and flexible body of smooth material, said body comprised of a single sheet and having a first end, a second end, a fold line between said first and second ends and a pair of sides extending from said first end toward said second end;

a gripping member near said second end; and closing strips provided along a portion of each of said pair of sides from near said first end to said fold line with the portions of said pair of sides extending from said fold line to said second end being free of closing strips.

22. An aid for putting on elastic stockings comprising:

a generally tubular configuration having a first end, a second end and a longitudinal axis, a pair of selectively releasable connection strips extending along said tubular configuration in a direction generally parallel to said longitudinal axis and a gripping member connected with and extending from said first end and past said second end, said gripping member forming the outermost surface of said tubular configuration and having a gripping end near said second end.

23. A method of putting on elastic stockings comprising the steps of:

providing an aid for putting on elastic stockings of the type having a body comprised of a single sheet and having a first end and a second end and a pair of sides extending from said first end to said second end, a gripping member positioned near said second end and closing strips provided along a portion of each of said pair of sides;

folding said body along a fold line generally parallel to said first end so that said gripping member extends past said first end;

forming the body into a generally tubular configuration and joining said closing strips so that the portion of said body between said fold line and said gripping member is on the outside of said tubular configuration;

applying said tubular configuration to the foot of a user;

applying an elastic stocking over said tubular configuration with a portion of said stocking engaging the portion of said body between said fold line and said gripping member;

releasing said closing strip; and removing said aid by exerting a pulling force on said gripping member.

24. The method of claim 23 wherein that portion of said body between said fold line and said gripping member slides relative to said stocking during said removal step.

* * * * *

UNITED STATES PATENT AND TRADEMARK OFFICE

CERTIFICATE OF CORRECTION

PATENT NO. : 6,032,839
DATED : March 7, 2000
INVENTOR(S) : Erik, et. al.

It is certified that error appears in the above-identified patent and that said Letters Patent is hereby corrected as shown below:

| | Reads | Should Be |
|---|---|---|
| Col. 4, line 24 | "**16, 50** that" | - - **16**, so that - - |
| Col. 4, line 28 | "in an case" | - - in any case - - |
| Col. 4, line 35 | "nor reliable" | - - not reliable - - |
| Col. 4, line 47 | "A Consequence" | - - A consequence - - |
| Col. 5, line 33 | "cop **104**" | - - top **104** - - |
| Col. 6, line 16 | "velcro" | - - Velcro - - |
| Col. 6, line 56 | "supply" | - - simply - - |
| Col. 6, line 60 | "cakes" | - - takes - - |
| Col. 7, line 10 | "**1a6**" | - - **146** - - |
| Col. 7, line 19 | "chat" | - - that - - |
| Col. 7, line 25 | "sheen" | - - sheet - - |
| Col. 7, line 29 | "ruiner" | - - runner - - |

UNITED STATES PATENT AND TRADEMARK OFFICE

CERTIFICATE OF CORRECTION

PATENT NO. : 6,032,839
DATED : March 7, 2000
INVENTOR(S) : Erik, et. al.

It is certified that error appears in the above-identified patent and that said Letters Patent is hereby corrected as shown below:

| | | |
|---|---|---|
| Col. 7, line 38 | "card" | - - cord - - |
| Col. 8, line 9 | "affected" | - - effected - - |
| Col. 8, line 48 | "sows" | - - shows - - |
| Col. 8, line 58 | "root" | - - foot - - |
| Col. 9, line 5 | "sheer" | - - sheet - - |
| Col. 9, line 33 | "toot" | - - foot - - |
| Col. 10, line 25 | "211, in a" | - - 211. In a - - |
| Col. 10, line 54 | "left our" | - - left out - - |

Signed and Sealed this

Eighth Day of May, 2001

*Attest:*

Nicholas P. Godici

NICHOLAS P. GODICI

*Attesting Officer*

*Acting Director of the United States Patent and Trademark Office*